US010066437B2

(12) United States Patent
Pritzkau et al.

(10) Patent No.: US 10,066,437 B2
(45) Date of Patent: Sep. 4, 2018

(54) STAGGERED STEP TRESTLE LADDER

(71) Applicant: THE BOEING COMPANY, Chicago, IL (US)

(72) Inventors: Stacy Pritzkau, Snohomish, WA (US); Kyle Arthur Hampton, Lake Stevens, WA (US); Jason Stamey, Snohomish, WA (US); Donald R. Crookston, Lake Stevens, WA (US); Ryan T. Dalseg, Mt. Vernon, WA (US); Solomon D. Langheld, Snohomish, WA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 15/215,079

(22) Filed: Jul. 20, 2016

(65) Prior Publication Data

US 2018/0023343 A1 Jan. 25, 2018

(51) Int. Cl.
*E06C 1/18* (2006.01)
*E06C 7/08* (2006.01)

(52) U.S. Cl.
CPC ..... *E06C 1/18* (2013.01); *E06C 7/082* (2013.01)

(58) Field of Classification Search
CPC ..... E06C 1/00; E06C 1/02; E06C 1/14; E06C 1/16; E06C 1/18; E06C 1/20; E06C 1/22; E06C 1/32; E06C 1/125; E06C 1/382
USPC ..... 182/180.1
See application file for complete search history.

(56) References Cited

U.S. PATENT DOCUMENTS 375,482 A * 12/1887 Ethridge ..... E06C 1/383 182/159
890,319 A * 6/1908 Wells ..... E06C 7/083 182/220
897,157 A * 8/1908 Rowe ..... E06C 7/083 182/220
1,198,739 A * 9/1916 Marciniak ..... E06C 1/005 182/156
2,171,863 A * 9/1939 Pirsch ..... E06C 7/083 182/215
2,229,987 A * 1/1941 Phelps ..... E06C 5/04 182/127
2,650,749 A * 9/1953 Balogh ..... E06C 7/083 182/220
2,827,216 A * 3/1958 Napolitano ..... E06C 1/125 182/104

(Continued)

*Primary Examiner* — Katherine W Mitchell
*Assistant Examiner* — Shiref M Mekhaeil
(74) *Attorney, Agent, or Firm* — COATS & BENNETT, PLLC

(57) ABSTRACT

A ladder has first and second support members, joined at their upper ends by a hinge. The first and second support members have left rail and a right rail that support plural first and second steps. Steps secured to the rails a fixed distance apart and are staggered so that the steps of the first support member begin at a different elevation than the steps of the second support member. The steps are wider than the rails to provide a larger surface for a user to stand. The ladder has a deployed position in which first ends of the first and second supports remain close and the second ends are spread apart and held in a distance apart by a spreader bar. Upon drawing the second ends of the first and second supports together, the steps of the first and second support member do not touch or interfere and may interleave.

17 Claims, 4 Drawing Sheets

(56) References Cited

U.S. PATENT DOCUMENTS

| | | | | | |
|---|---|---|---|---|---|
| 3,005,513 | A * | 10/1961 | Larson | E06C 1/20 | 182/108 |
| 3,042,140 | A * | 7/1962 | Basile | E06C 1/39 | 182/125 |
| 4,270,463 | A * | 6/1981 | Korzon | A47B 57/26 | 108/147.11 |
| 5,577,574 | A * | 11/1996 | Joseph | E06C 1/18 | 182/104 |
| 7,931,123 | B2 * | 4/2011 | Moldthan | E06C 1/387 | 182/129 |
| 8,701,828 | B1 * | 4/2014 | Matthew | E06C 1/18 | 182/129 |
| 9,422,767 | B2 * | 8/2016 | Russell | E06C 1/18 | |
| 2005/0173194 | A1 * | 8/2005 | Pate | E06C 1/20 | 182/217 |
| 2008/0029339 | A1 * | 2/2008 | Yewer | E06C 1/18 | 182/104 |
| 2013/0327593 | A1 * | 12/2013 | Perkins | E06C 1/14 | 182/180.1 |
| 2015/0060201 | A1 * | 3/2015 | Hume | E06C 1/18 | 182/104 |
| 2015/0159434 | A1 * | 6/2015 | Leng | E06C 1/20 | 182/163 |
| 2015/0164715 | A1 * | 6/2015 | Allred, III | A61G 1/044 | 5/626 |
| 2015/0308190 | A1 * | 10/2015 | Skubic | E06C 1/393 | 182/124 |
| 2016/0032650 | A1 * | 2/2016 | Mora | B21J 15/02 | 182/215 |
| 2016/0138335 | A1 * | 5/2016 | Moss | E06C 1/18 | 182/104 |

* cited by examiner

STAGGERED STEP TRESTLE LADDER

TECHNOLOGICAL FIELD

The technological field of the present disclosure is the field of ladders, and in particular, trestle ladders.

BACKGROUND

Ladders are used for working at an elevation above ground level. Ladders include, for example, step ladders and extension ladders. Step ladders have a set of steps attached to a pair of rails. The rails are hinged to a frame to brace the ladder for free-standing use by a worker. A worker stands on one of the steps to work at an elevation, usually not many feet from the ground. An example of a step ladder is shown and described in U.S. Pat. No. 1,198,739 issued to Marciniak et al., and is incorporated herein in its entirety by reference. A double-sided step ladder is shown and described in U.S. Pat. No. 7,931,123, issued to Moldthan et al, and which is also incorporated herein in its entirety by reference.

Extension ladders are longer than step ladders, made for use leaning against another surface such as a building, and, because they have rungs and reach surfaces at higher elevations such as a roof, are best used to climb from the ground to the elevated surface from which surface the user can work. Extension ladders are not comfortable to stand on or particularly safe to work from for long periods of time.

Another type of ladder for working above ground level is called a trestle ladder, which includes two support members that are hinged at the top ends of the support members so that their opposing ends can be pivoted to a deployed position from a closed position to form a stable base. The sides of the trestle ladder have rungs. A plank is commonly placed on the rungs of two trestle ladders, thereby creating the "trestle" so as to create an elevated platform—the elevated plank—on which workers may stand.

A ladder that may be quickly positioned, is safe and reasonably comfortable for workers to stand on, and is compact for transport and storage would be of advantage.

SUMMARY

Disclosed herein is a ladder having a first support member and a second support member. The first and second support members have a first end and a second end. The first support member includes a left rail and a right rail spaced a fixed distance from the left rail. The second support member likewise includes a left rail and a right rail, which are also spaced a fixed distance. The first support member includes plural first steps that are located at predetermined distances from its first end; and the second support member has plural second steps and these are located at predetermined distances from the first end of the second support so that the plurality of second steps are staggered relative to the plural first steps on the first support member. The second support member has a predetermined width.

An aspect of the disclosure is that the first end of the first support member and the first end of the second support member pivot between a deployed position wherein the first end of the first support member and the first end of the second support member are spaced apart, and a closed position wherein the first end of the first support member and the first end of the second support member are drawn close together.

A further aspect of the disclosure is that, when the first support member and the second support member are in the closed position, the plural first steps and the plural second steps do not touch or interfere, and the plural first steps of the first support member may interleave with the plural second steps of the second support member.

Another aspect of the disclosure is a hinge attached to the second end of the first support member and to the second end of the second support member so the first support member and second support member may pivot between the deployed and the closed positions.

An aspect of the disclosure is that the first plural steps may have a width, which is measured in a horizontal direction from the presenting edge of a step or tread to the trailing edge of the step or tread, and which width is greater than the width of the support member to provide more support for the user's foot.

Another aspect of the disclosure is plural gussets or struts to secure steps to rails. At least one gusset or strut is used for attaching a step of the plural first steps to the first support member.

Another aspect of the disclosure is a spreader bar connecting the first support member and the second support member to limit the spread of the first end of the first support member with respect to the first end of the second support member when pivoted to the deployed position.

These and other aspects of the disclosure will be apparent to those skilled in the design of ladders from a careful reading of the Detail Description of the Disclosure accompanied by the following drawings.

BRIEF DESCRIPTION OF THE DRAWINGS

Figure 1:
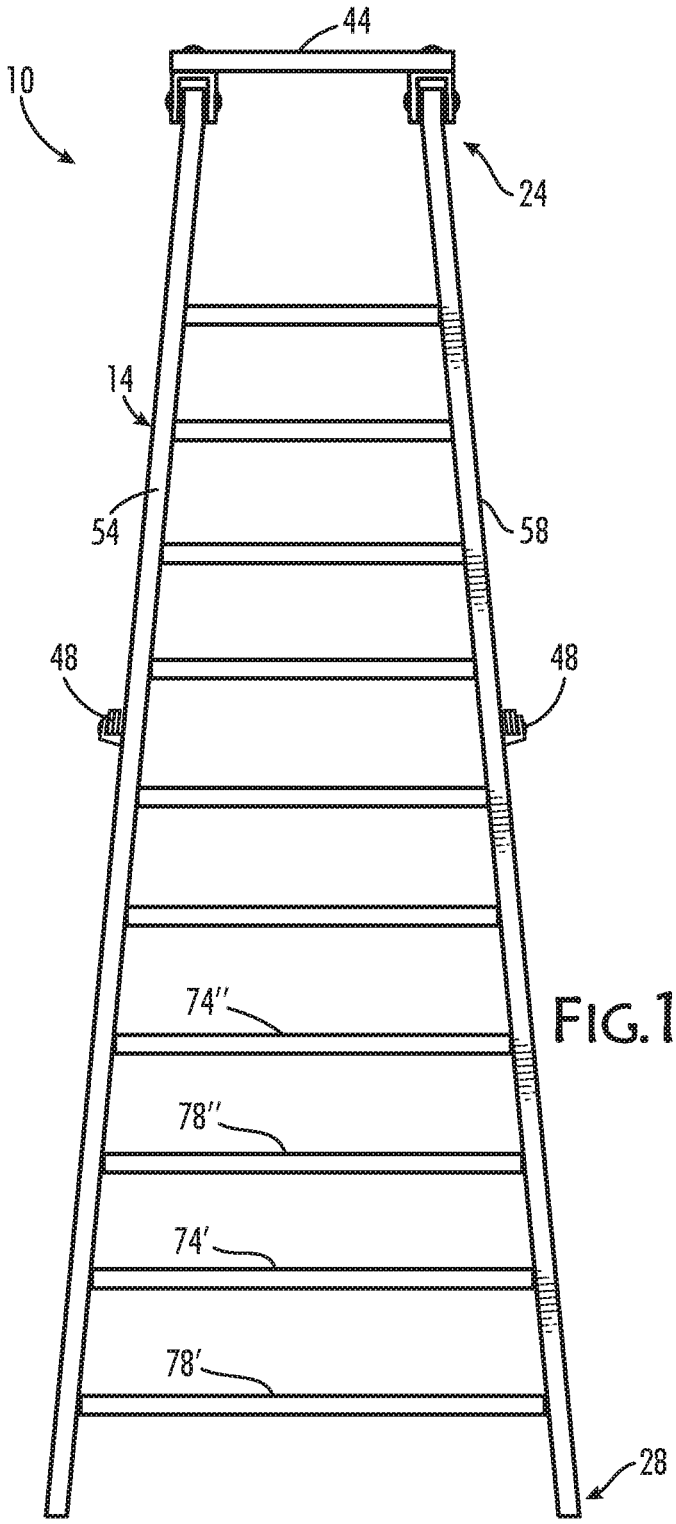
Figure 2:
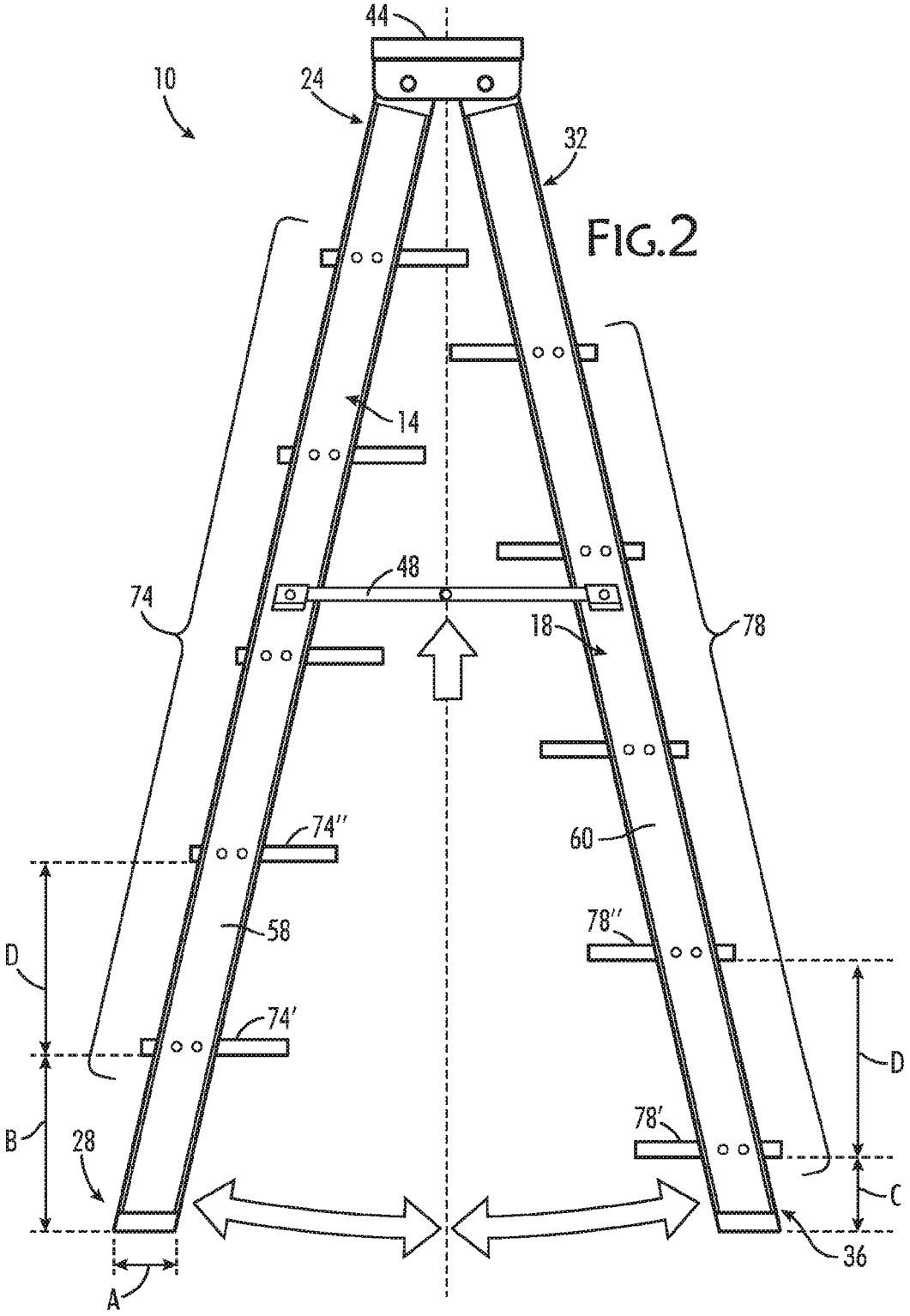
Figure 3:
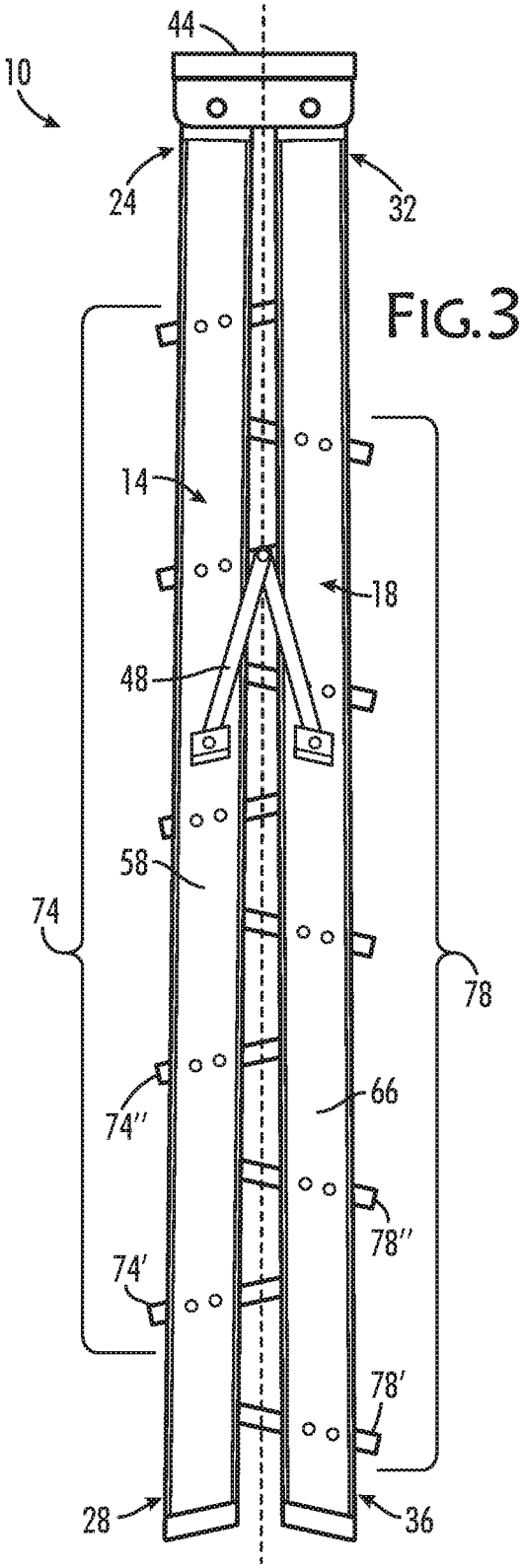
Figure 4:
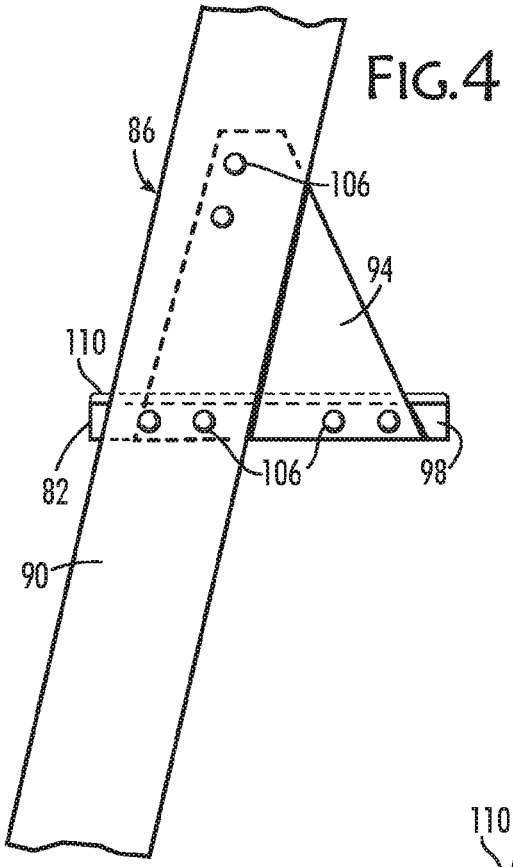
Figure 5:
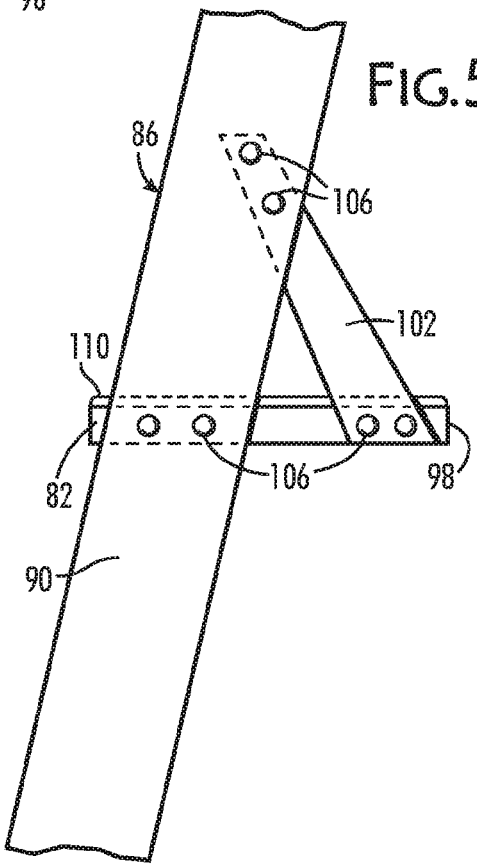

Having thus described variations of the disclosure in general terms, reference will now be made to the accompanying drawings, which are not necessarily drawn to scale, and wherein:

FIG. 1 is a front view of a ladder according to aspects of the disclosure;

FIG. 2 is a side view of the ladder of FIG. 1 shown in the deployed position, according to aspects of the disclosure;

FIG. 3 is a side view of the ladder of FIG. 1 shown in the closed position, according to aspects of the disclosure;

FIG. 4 is a detailed view of a ladder with a step supported by a gusset, according to an aspect of the disclosure; and FIG. 5 is a detailed view of a ladder and step supported by a strut, according to an aspect of the disclosure.

DETAILED DESCRIPTION OF THE DISCLOSURE

Referring now to FIGS. 1-3, there is illustrated a ladder 10 as seen from the front and from the sides. FIG. 1 shows ladder 10 from the front. FIGS. 2 and 3 show ladder 10 from the side. Ladder 10 is shown in the deployed position in FIG. 2, and shown in the closed position in FIG. 3. Ladder 10 has a first support member 14 and a second support member 18. First support member 14 and second support members 18 are visible in FIGS. 2 and 3; second support member 18 is obscured by first support member 14 in FIG. 1.

First support member 14 has a first end 24 and a second end 28; likewise, second support member 18 has a first end 32 and a second end 36. First end 24 of the first support member 14 and the first end 32 of the second support member 18 are attached to a hinge 44 so that second end 28 of first support member 14 and second end 36 of second support member 18, respectively, can be pivoted while first end 24 of first support member 14 and first end 32 of second support member 18 remain joined together, as indicated by the arrows in FIG. 2 and by comparing FIG. 2, which shows ladder 10 in the deployed position, to FIG. 3, which shows ladder 10 in the closed position. At least one spreader bar 48 connects first support member 14 and second support member 18 to limit the distance that second ends 28 of first support member 14 and second end 36 of second support members 18 can be spaced apart. When in a closed position as shown in FIG. 3, ladder 10 is compact for storing and transporting.

First support member 14 has a left rail 54 and a right rail 58. Second support member 18 has a left rail 62 and a right rail 66. Left rail 54 and right rail 58 of first support member 14 and left rail 62 and right rail 66 are spaced a fixed distance apart, which distance may be a uniform distance or, as best seen in FIG. 1 which may be distances that increase from first end 24 to second end 28 and from first end 32 to second end 36 for greater stability. First support member 14 and second support member 18 have a width. The width is indicated by the letter A in FIG. 2, is the equal to the horizontal distance from the leading edge of second end 36 of second support member 18 to its trailing edge when second support member 18 is in the deployed position.

First support member 14 carries plural first steps 74 and second support member 18 carries plural second steps 78. Plural first steps 74 and plural second steps 78 may be wider than the width A of second support member 18, and may be at least 15 cm wide, and may be up to 24 cm wide, in order to provide a step having the width to accommodate the heel and ball of the foot of a worker for greater stability and comfort when the worker is working at elevation and standing on any of plural first steps 74 or any of plural second steps 78. The width of plural first steps 74 and plural second steps 78 is measured in the same direction as the width A of second support member 18. Wider plural first steps 74 and plural second steps 78 make it more comfortable and less tiring for workers who stand on ladder 10 for long periods of time as their feet are supported at the heels and the balls of their feet.

A bottom first step 74' of plural first steps 74 is disposed on first support member 14 at a first predetermined distance B from first end 24 of first support member 14. Likewise, plural second steps 78 of second support member 18 have a bottom second step 78' disposed on second support member 18 at a second predetermined distance C from first end 32. The predetermined distances for a next first step 74" of plural first steps 74 and a next second step 78" of the plural second steps 78 are chosen so that plural first steps 74 on the first support member 14 and plural second steps 78 on the second support member 18 are staggered. The term staggered herein means that no step of plural first steps 74 is at the same elevation above second end 28 of first support member 14 as a step of plural second steps 78, so that, when ladder 10 is viewed from the front, as it is illustrated in FIG. 1, plural first steps 74 and plural second steps 78 are visible and not blocked from view. Moreover, when first support member 14 and the second support member 18 are pivoted between the deployed position and the closed position, plural first steps 74 and plural second steps 78 do not touch or interfere, and may interleave when in the closed position, as best seen in FIG. 3, so that, for example, bottom first step 74' of the first support member 14 is at an elevation between bottom second step 78' and next second step 78" of the second support member 18.

Plural first steps 74 may be separated by a third predetermined distance D. Plural second steps 78 may also be separated by the same predetermined distance D, which may be, for example, 30 cm. (or 15 inches). Bottom first step 74" of plural first steps 74 of first support member 14 may be separated by predetermined distance D from next first step 74'. Bottom second step 78' of plural second steps 78 on second support member 18 may be a predetermined distance C from second end 36 of second support member 18, which predetermined distance C may be 15 cm (6 inches), and then next second step 78" may be separated from bottom second step 78' by predetermined distance D. Comparing FIG. 2 and FIG. 3 illustrates staggering of plural first steps 74 and plural second steps 78, and that they do not touch or interfere when drawn from the deployed (FIG. 2) to the closed position (FIG. 3) and they may interleave.

When plural first steps 74 of first support member 14 are staggered and interleaved relative to plural second steps 78 of second support member 18, the user may select among plural first steps 74 of first support member 14 and plural second steps 78 of second support member 18 for the user to be at a good elevation for working.

Referring now to FIGS. 4 and 5, there are shown details of the attachment of a step 82 to a rail 90. In FIG. 4, a step 82 of a ladder 86 is secured to a rail 90 in a fixed manner so that step 82 does not move when a worker climbs ladder 86 and places weight on step 82. The attachment of step 82 to rail 90 is secured, as shown in FIG. 4, by gusset 94 that supports step 82 from rail 90. The word gusset is used herein to refer to a bracket for joining two members at an angle. Here, gusset 94 is used to join rail 90 to step 82 to provide the strength to support a cantilevered distal end 98 of step 82.

FIG. 5 illustrates a different structure for supporting step 82 from rail 90, namely, by using a strut 102. As used herein a strut is a brace connecting and strengthening two members. Strut 102 connects rail 90 to distal end 98 of step 82 to provide additional support for the weight of a worker on step 82. Bolts 106 with washers and nuts can be used to secure gussets 94 and struts 102 to step 82 and rail 90

FIGS. 4 and 5 also show a tread 110 on step 82. Tread 110 is a surface on top of step 82 that is the engaged by the foot of the worker. Tread 110 may be a slip-resistant material adhered to step 82 or may be structural, that is, attached so as to provide support for the weight of the worker. Tread 110 may also be narrower than step 82, meaning, in a direction perpendicular to width A, so that tread may extend easily between rails 90.

When introducing elements of the present disclosure or exemplary aspects thereof, the articles "a," "an," "the" and "said" are intended to mean that there are one or more of the elements. The terms "comprising," "including" and "having" are intended to be inclusive and mean that there may be additional elements. Although this disclosure has been described with respect to specific aspects, the details of these aspects are not to be construed as limitations.

What is claimed is:

1. A ladder comprising:

a first support member having a first end and a second end, the first support member having a left rail and a right rail, wherein the left rail of the first support member and the right rail of the first support member are spaced a fixed distance apart, and wherein the first support member has a width;

a second support member having a first end and a second end, the second support member having a left rail and a right rail, wherein the left rail of the second support member and the right rail of the second support member are spaced a fixed distance apart, and wherein the second end of the second support member is attached to the second end of the first support member;

plural first steps disposed on the first support member located at predetermined distances from the first end; and plural second steps disposed on the second support member located staggered relative to the plural first steps on the first support member;

wherein each of the first steps are wider than the left and right rails of the first support member, and are mounted thereto so as to extend both inward and outward farther than the left and right rails of the first support member;

wherein each of the second steps are wider than the left and right rails of the second support member, and are mounted thereto so as to extend both inward and outward farther than the left and right rails of the second support member;

wherein each first step of the plural first steps is attached to the first support member by a corresponding gusset; wherein each gusset is affixed directly to one of the left and right rails of the first support member at a point above a corresponding first step of the plurality of first steps that the gusset supports;

wherein each gusset is distinct from each first step;

wherein each gusset is directly attached to the corresponding first step by fasteners extending through both the gusset and the corresponding first step; wherein at least two of the fasteners each extends through the gusset, one of the left and right rails of the first support member and into the corresponding first step;

wherein each gusset extends above the corresponding first step, but does not extend lower than the corresponding first step, such that no portion of a given gusset is disposed below the corresponding first step.

2. The ladder of claim 1, wherein the first end of the first support member and the first end of the second support member are movable between a deployed position, wherein the first end of the first support member and the first end of the second support member are spaced apart, and a closed position, wherein the first end of the first support member and the first end of the second support member are drawn together.

3. The ladder of claim 2, wherein, when the first support member and the second support member are in the closed position, the plural first steps of the first support member and the plural second steps of the second support member do not touch.

4. The ladder of claim 2, wherein, when the first support member and the second support member are in the closed position, the plural first steps of the first support member interleave with the plural second steps of the second support member.

5. The ladder of claim 1, further comprising a hinge connecting the second end of the first support member to the second end of the second support member, wherein the first end of the first support member and the first end of the second support member are pivotable between a deployed position and a closed position.

6. The ladder of claim 1:

wherein the plural first steps comprise:

a bottom first step; and a next first step, the next first step being spaced a first predetermined distance above the bottom first step; and wherein the plural second steps comprise:

a bottom second step; and a next second step, the next second step being spaced a second predetermined distance above the bottom second step.

7. The ladder of claim 6, wherein the first predetermined distance the second predetermined distance are the same.

8. The ladder of claim 6, further comprising a hinge connecting the second end of the first support member to the second end of the second support member, wherein the first end of the first support member and the first end of the second support member are pivotable between a deployed position, wherein the first end of the first support member and the first end of the second support member are spaced apart, and a closed position, wherein the first end of the first support member and the first end of the second support member are drawn together.

9. The ladder of claim 8, wherein, when the first support member and the second support member are in the closed position, the bottom first step and the next first step interleave with the bottom second step and the next second step.

10. The ladder of claim 1, further comprising:

a hinge connecting the second end of the first support member to the second end of the second support member, wherein the second end of the first support member and the second end of the second support member are pivotable between a deployed position and a closed position; and a spreader bar connecting the first support member and the second support member, the spreader bar limiting spread of the first end of the first support member with respect to the first end of the second support member.

11. The ladder of claim 10, wherein, when the first support member and the second support member are in the closed position, plural first steps of the first support member do not interfere with plural second steps of the second support member.

12. The ladder of claim 10, wherein when the first support member and the second support member are in the closed position, plural first steps of the first support member interleave with plural second steps of the second support member.

13. A ladder comprising:

a first support member having a first end and a second end, the first support member having a left rail and a right rail, wherein the left rail of the first support member and the right rail of the first support member are spaced a fixed distance apart, and wherein the first support member has a width;

a second support member having a first end and a second end, the second support member having a left rail and a right rail, wherein the left rail of the second support member and the right rail of the second support member are spaced a fixed distance apart, and wherein the second end of the second support member is attached to the second end of the first support member;

plural first steps disposed on the first support member located at predetermined distances from the first end; and plural second steps disposed on the second support member located staggered relative to the plural first steps on the first support member;

wherein each of the first steps are wider than the left and right rails of the first support member, and are mounted thereto so as to extend both inward and outward farther than the left and right rails of the first support member;

wherein each of the second steps are wider than the left and right rails of the second support member, and are mounted thereto so as to extend both inward and outward farther than the left and right rails of the second support member;

wherein each first step of the plural first steps is attached to the first support member by a strut; wherein each strut is affixed directly to one of the left and right rails of the first support member at two points above a corresponding first step of the plurality of first steps that the strut supports;

wherein each strut is distinct from each first step;

wherein each strut is directly attached to its corresponding first step by fasteners extending through both the corresponding first step and the strut; wherein at least two of the fasteners each extends through the strut, one of the left and right rails of the first support member and into the corresponding first step;

wherein each strut extends above the corresponding first step, but does not extend lower than the corresponding first step, such that no portion of a given strut is disposed below the corresponding first step.

14. The ladder of claim 13, wherein the first end of the first support member and the first end of the second support member are movable between a deployed position, wherein the first end of the first support member and the first end of the second support member are spaced apart, and a closed position, wherein the first end of the first support member and the first end of the second support member are drawn together.

15. The ladder of claim 14, wherein, when the first support member and the second support member are in the closed position, the plural first steps of the first support member and the plural second steps of the second support member do not touch.

16. The ladder of claim 14, wherein, when the first support member and the second support member are in the closed position, the plural first steps of the first support member interleave with the plural second steps of the second support member.

17. The ladder of claim 13:

wherein the plural first steps comprise:

a bottom first step; and a next first step, the next first step being spaced a first predetermined distance above the bottom first step; and wherein the plural second steps comprise:

a bottom second step; and a next second step, the next second step being spaced a second predetermined distance above the bottom second step.

* * * * *